US007205512B2

(12) United States Patent
Takagi et al.

(10) Patent No.: US 7,205,512 B2
(45) Date of Patent: Apr. 17, 2007

(54) FIXING DEVICE USING INDUCTION HEATING

(75) Inventors: Osamu Takagi, Tokyo-To (JP); Satoshi Kinouchi, Tokyo-To (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/680,303

(22) Filed: Oct. 8, 2003

(65) Prior Publication Data

US 2004/0065660 A1 Apr. 8, 2004

Related U.S. Application Data

(60) Division of application No. 10/196,929, filed on Jul. 18, 2002, now Pat. No. 6,646,239, which is a continuation of application No. 09/853,698, filed on May 14, 2001, now Pat. No. 6,455,824, which is a division of application No. 09/472,819, filed on Dec. 28, 1999, now Pat. No. 6,255,633.

(51) Int. Cl.
*H05B 6/14* (2006.01)
*G03G 15/20* (2006.01)

(52) U.S. Cl. ..... 219/619; 219/672; 219/676; 399/328; 399/330

(58) Field of Classification Search ..... 219/619, 219/672, 674, 676; 399/328–338; 336/199–209
See application file for complete search history.

(56) References Cited

U.S. PATENT DOCUMENTS 2,649,527 A 8/1953 Chapman et al.
2,888,541 A * 5/1959 Netzer ..... 219/676
4,029,926 A 6/1977 Austin
4,329,565 A 5/1982 Namiki et al.
4,355,222 A 10/1982 Geithman et al.
4,570,044 A 2/1986 Kobayashi et al.
5,101,086 A 3/1992 Dion et al.
5,374,810 A * 12/1994 Gantt ..... 219/670
5,752,150 A 5/1998 Kato et al.
5,778,293 A 7/1998 Ohtsuka
5,819,150 A 10/1998 Hayasaki et al.

(Continued)

FOREIGN PATENT DOCUMENTS

JP 55-120096 U 8/1980

(Continued)

*Primary Examiner*—Philip H. Leung
(74) *Attorney, Agent, or Firm*—Foley & Lardner LLP

(57) ABSTRACT

An electrophotography fixing device has a heating roller and an induction heating device. In order to improve heat resistance, heat radiating performance and insulation performance and in order to appropriately uniformly heat the heating roller, in the induction heating device, induction heating coils wound onto a core are fixed by varnish mixed with mica, and the outside surfaces thereof are fixed by a heat resistant bundling band or a molded body of a heat resistant material, or coated with a heat resistant, insulating and thermal conductive sheet. Alternatively, the same sheets as the above described sheet are provided between the core and the coils and between the layers of the coils. In addition, the core is formed with a hole extending in axial directions or holes extending in directions perpendicular to the axial directions. Moreover, the coils are doubly insulated.

9 Claims, 10 Drawing Sheets

U.S. PATENT DOCUMENTS

| | | | | | |
|---|---|---|---|---|---|
| 5,866,884 | A | * | 2/1999 | Cornec et al. | 219/622 |
| 5,895,598 | A | | 4/1999 | Kitano et al. | |
| 6,026,273 | A | | 2/2000 | Kinouchi et al. | |
| 6,078,781 | A | | 6/2000 | Takagi et al. | |
| 6,087,641 | A | | 7/2000 | Kinouchi et al. | |
| 6,252,212 | B1 | | 6/2001 | Takagi et al. | |
| 6,255,633 | B1 | | 7/2001 | Takagi et al. | |

FOREIGN PATENT DOCUMENTS

| | | | | | |
|---|---|---|---|---|---|
| JP | 57-133607 | | * | 8/1982 | 336/199 |
| JP | 59-33476 | A | | 2/1984 | |
| JP | 63-139794 | U | | 9/1988 | |
| JP | 3-90200 | | * | 4/1991 | 219/246 |
| JP | 3-266391 | A | | 11/1991 | |
| JP | 4-262392 | A | | 9/1992 | |
| JP | 4-306584 | A | | 10/1992 | |
| JP | 8-76620 | | | 3/1996 | |
| JP | 10-074001 | A | | 3/1998 | |
| JP | 10-074009 | A | | 3/1998 | |
| JP | 10-106739 | A | | 4/1998 | |
| JP | 10-111610 | A | | 4/1998 | |
| JP | 2000-029336 | A | | 1/2000 | |

* cited by examiner

FIXING DEVICE USING INDUCTION HEATING

The present application is a Divisional of U.S. application Ser. No. 10/196,929, filed Jul. 18, 2002; now U.S. Pat. No.6,646,239 which '929 application is a continuation of Ser. No. 09/853,698, filed May 14, 2001; now U.S. Pat. No. 6,455,824 which '698 application is a divisional of Ser. No. 09/472,819 filed Dec. 28, 1999, now U.S. Pat. No. 6,255,633 the entire contents of which are incorporated herein by reference.

BACKGROUND OF THE INVENTION

1. Field of The Invention

The present invention relates generally to a fixing device using the induction heating, which is used for fixing an image, such as a toner image, on a fixed material, such as a paper, in an image forming system, such as an electrophotography system, an electrostatic process copying machine or a laser printer.

2. Related Background Art

Conventionally, there is known the following fixing device for an electrophotography system. That is, a halogen lamp or the like is used as a heat source. This is provided inside of a heating roller of a metal to heat the heating roller. A pressure roller having an elastic material at least on the surface thereof is provided so as to face the heating roller while pressingly contacting the heating roller. A paper serving as a fixed material is caused to pass through a nip portion formed between the two rollers contacting each other. During the passing, a toner image on the paper is melted and fixed. There is also known a fixing device wherein a flash lamp is used for heating a paper without contacting the paper to fix a toner image. Moreover, as fixing devices having improved efficiency, there are known a fixing device having magnetic field producing means combined with a belt as shown in Japanese Patent Laid-Open No. 8-76620, and a fixing device using a heating member of a ceramics as shown in Japanese Patent Laid-Open No. 59-33476.

However, there are various problems in the above described conventional fixing devices. That is, in the fixing device utilizing the induction heating based on an induction coil, it is actually very difficult to uniformly heat the heating roller. In order to optimize the heating efficiency to realize the uniform heating, it is required to optimize the construction of the induction coil itself, but this is actually remarkably difficult.

With respect to the uniform heating of the heating roller, it is also required to prevent the non-uniformity of temperature of the heating roller in axial directions (cross directions) thereof. The conventional device using the halogen lamp heater is designed to cope with it by changing the light distribution characteristics. Also in the induction heating fixing devices, it is required to take measures to obtain the same effects.

Comparing the induction heating coil with the coil of the existing motor or the like, the working environment of the induction heating coil is greatly different from that of the coil of the existing motor or the like. Therefore, unlike the coil of the motor or the like, the shape of the induction heating coil must be selected particularly in view of heat resistance.

SUMMARY OF THE INVENTION

It is therefore an object of the present invention to eliminate the aforementioned problems and to provide a light and inexpensive fixing device for an electrophotography system or the like, the fixing device using an induction heating device (coil), to which a great electric power is supplied to be necessarily heated to a high temperature, and a heating roller heated by the induction heating device, the fixing device having excellent heat resistance, heat radiating performance and insulation performance, and the fixing device being capable of heating the heating roller uniformly and adequately on the basis of the relationship between the positions of the heating roller and a fixed material.

In order to accomplish the aforementioned and other objects, according to one aspect of the present invention, there is provided a fixing device using induction heating for causing alternating current to pass through electromagnetic induction coils, which are arranged so as to be close to an endless member having a metal layer of a conductive material, to cause the endless member to generate heat to heat a member to be fixed, wherein the fixing of the electromagnetic induction coils to each other and the fixing of the core to the coils are carried out by an adhesive material mixed with mica.

According to another aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the electromagnetic induction coil is wound onto a core of a non-magnetic material coated with a resin or paint.

According to another aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the coil is wound around a first axis, and the coil thus wound is fixed by winding a heat resistant bundling band onto the coil around a second axis substantially perpendicular to the first axis.

According to another aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the coil is wound around a first axis, and the coil thus wound is fixed by a molded body of a heat resistant material having a member wound onto the coil around an axis perpendicular to at least the first axis.

According to another aspect of the present invention, there is provided a fixing device using induction heating for causing alternating current to pass through electromagnetic induction coils, which are arranged so as to be close to an endless member having a metal layer of a conductive material, to cause the endless member to generate heat to heat a member to be fixed, wherein a heat resistant, insulating and heat conductive sheet for providing both of heat radiation and insulation of the coils is provided on the surfaces of the coils.

According to another aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the coil is wound onto a core of a non-magnetic material, and a heat resistant, insulating and heat conductive sheet for providing both of heat radiation and insulation of the coils is provided between the surface of the core and the coil.

According to another aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the center of the coil in axial directions is offset from the center of the endless member, which serves as an object to be heated, in axial directions in accordance with thermal load of the endless member.

According to another aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the coil is wound onto a core of a non-magnetic material, and the core has a hole extending in directions substantially perpendicular to the axis of the core.

According to a further aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the coil is wound onto a core of a non-magnetic material, and the core has a first hole extending in the axial directions of the core.

According to a still further aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the coil has a plurality of unit wires, each of which comprises a conductor coated with a first insulating coating, and the plurality of unit wires are coated with a second insulating coating to doubly isolate the coil from the endless member.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, the preferred embodiments of the present invention will be described below.

Figure 1:
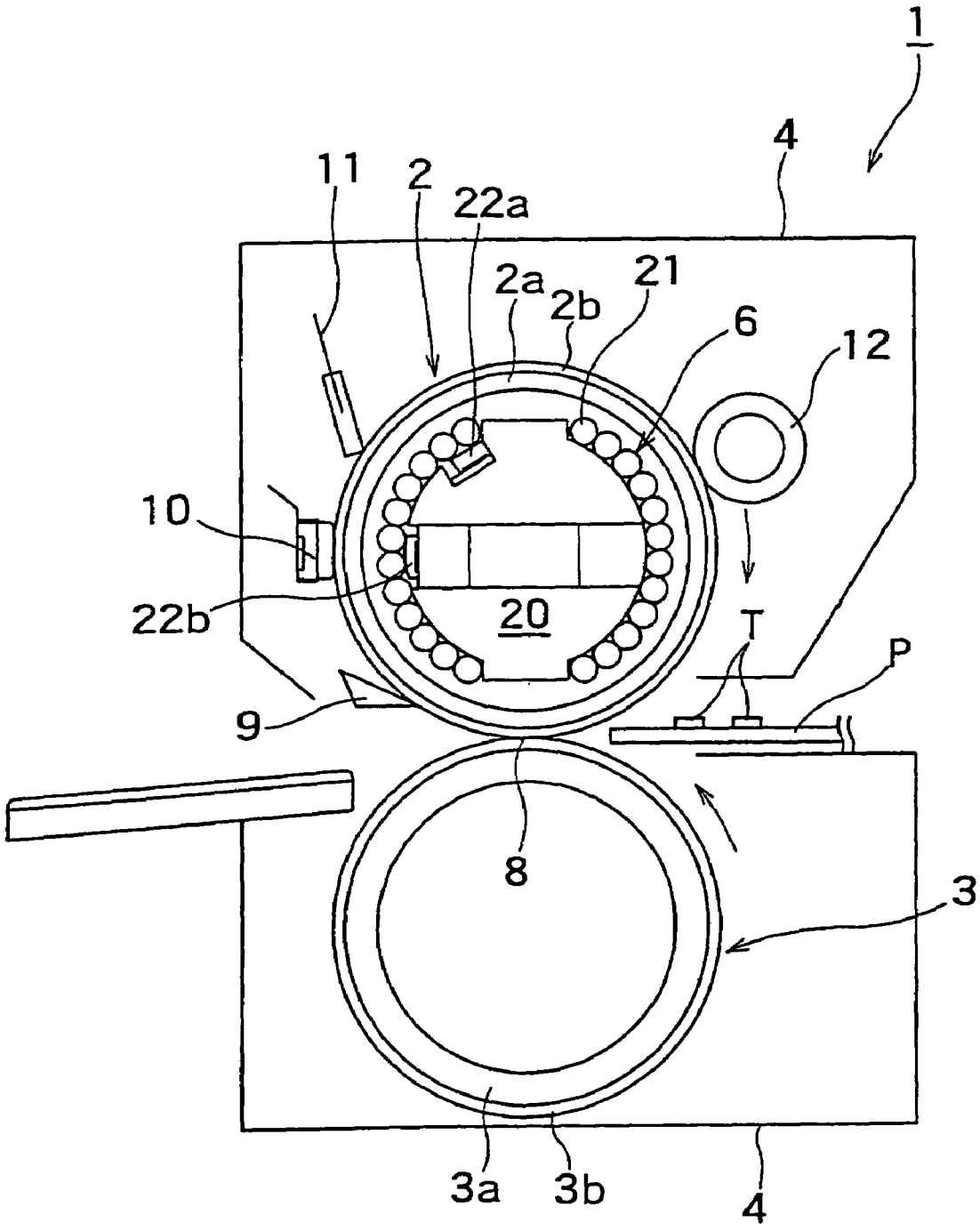
FIG. 1 is a schematic side view showing the whole construction of a preferred embodiment of a fixing device according to the present invention.
Figure 2:
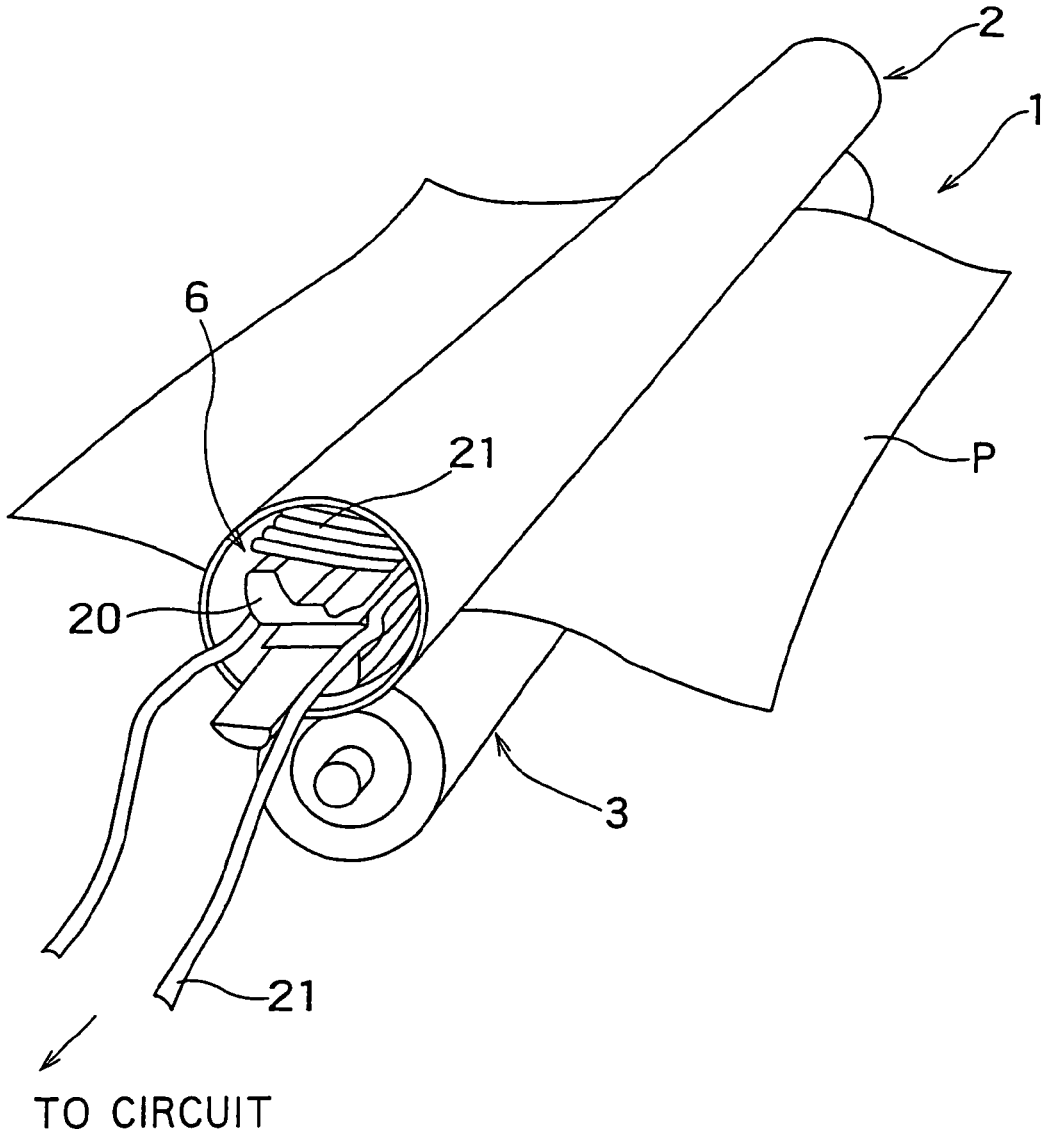
FIG. 2 is a schematic perspective view showing a heating roller, an induction heating device and a pressure roller of the fixing device shown in FIG. 1.
Figure 7:
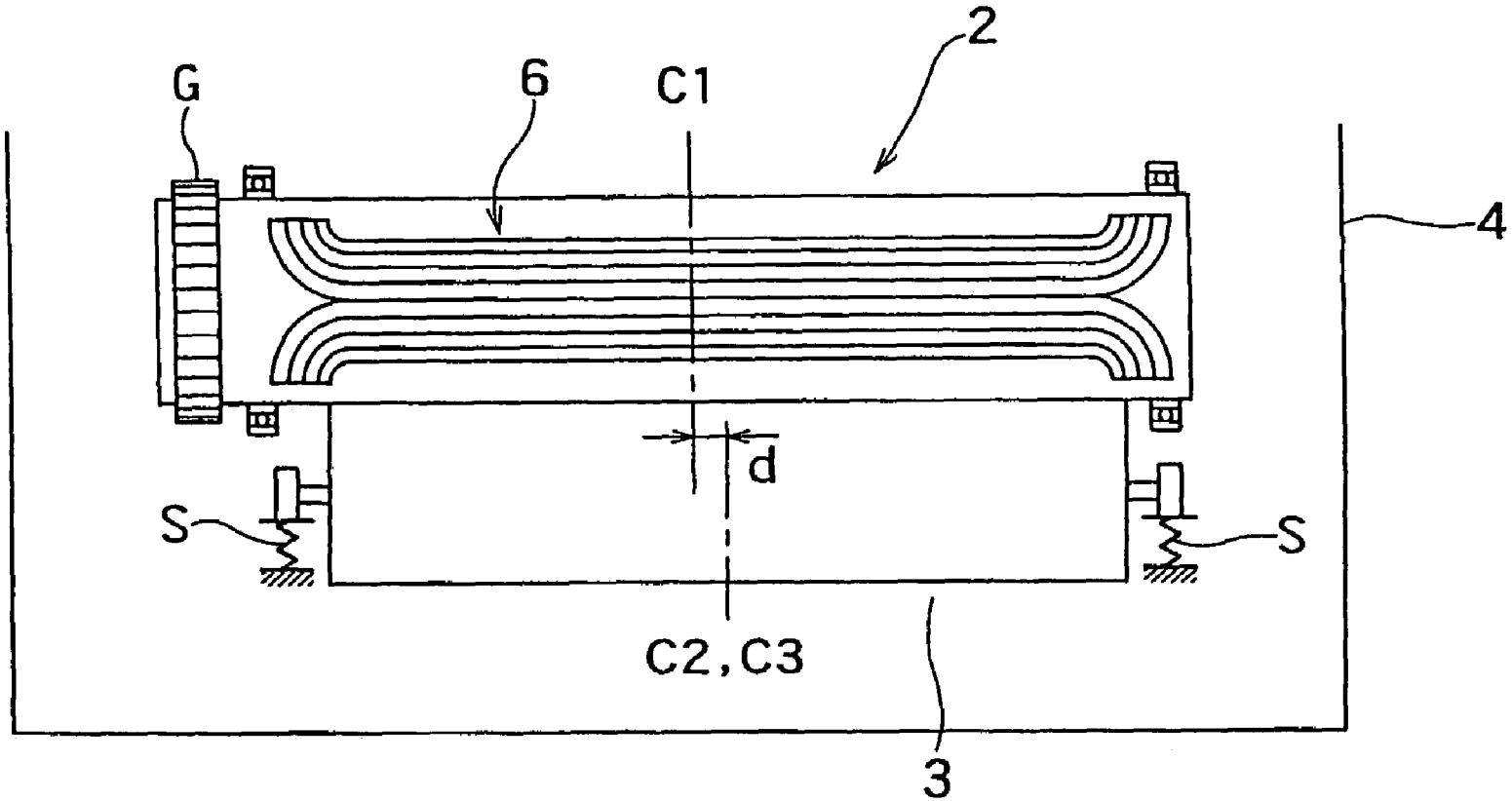
FIG. 7 is an illustration for explaining the relationship between the positions of a heating roller, an induction heating device and a pressure roller.

FIG. 1 is a schematic sectional view of the whole construction of a fixing device 1 for fixing a toner image serving as an image on a fixed material (a paper) in an electrostatic process copying machine or the like. FIG. 2 is a perspective view of a principal part (a heating roller 2 and a pressure roller 3) of the fixing device 1 with a paper P. FIG. 7 shows the relationship between the positions of the two rollers.

The fixing device 1 is designed to melt and fix a toner on the paper P serving as a fixed material by causing the paper P, which is arranged on the right side in FIG. 1, to pass through a portion (nip portion) between the upper high-temperature heating roller (fixing roller) 2 and the lower pressure roller (press roller) 3, which pressingly contact each other, from the right to the left.

Specifically, the heating roller 2 is supported on a bearing rotatably with respect to a body (chassis) 4, and rotated clockwise by a driving motor (not shown). The heating roller 2 is formed of an endless member, e.g., a cylindrical member of Ø40 mm. For example, the heating roller 2 may be formed by winding a heat resistant belt between two pulleys to house therein an induction heating device 6, which will be described later, as long as it is formed of an endless member. The pressure roller 3 is rotatably mounted on the body 4 so as to pressingly contact the heating roller 2. For example, as can be seen from FIG. 7, the rotatably supported pressure roller 3 may be biased by springs S against the heating roller 2 so as to pressingly contact the heating roller 2. That is, the pressure roller 3 pressingly contacts the heating roller 2 to be held so as to form a nip portion 8 having a predetermined width. The pressure roller 3 itself has no driving mechanism, and is driven counterclockwise by the heating roller 2.

Moreover, the heating roller 2 has a double structure, the inside structure of which comprises a body 2*a* of iron having a thickness of, e.g., 1 mm. In place of iron, stainless, aluminum, a composite material of stainless and aluminum, or the like may be used. The outside surface of the body 2*a* is coated with a mold releasing layer 2*b* of teflon or the like. In addition, the pressure roller 3 pressingly contacting the heating roller 2 has a double structure comprising a core 3*a* and an outside coating layer 3*b* of an elastic material, such as silicon rubber or fluoro rubber, for coating the core 3*a*.

In the internal cavity of the heating roller 2, the induction heating device (magnetic field generating means) 6 is provided so as to be fixed to the body 4. By the induction heating device 6, the iron body 2*a* of the heating roller 2 is heated. By the heating roller 2 thus heated, the developer (toner) on the paper P is melted and fixed.

Around the heating roller 2, various devices are provided. That is, slightly downstream of the contact position (nip portion) 8 between the heating roller 2 and the pressure roller 3 in rotation directions, a peeling claw 9 for peeling the paper P from the heating roller 2 is provided. Downstream of the peeling claw 9 in rotational directions, a thermistor 10 for detecting the temperature of the heating roller 2 is provided. Downstream of the cleaning member 11, i.e., upstream of the nip portion 8, at which fixing is carried out, a mold releasing agent applying device 12 for applying a mold releasing agent for preventing the offset of the toner is provided.

Then, the induction heating device 6 will be described in detail. The device 6 comprises a core (coil supporting member) 20 of a heat resistant resin, such as a high heat resistant industrial plastic, and an exciting coil 21 wound onto the core 20. The exciting coil 21 allows alternating current to effectively pass through a litz wire. For example, the coil 21 is formed of a bundle of 19 wires (unit wires), each of which is coated with a heat resistant polyamideimide or polyamide and each of which has a diameter of 0.5 mm. As described above, the coil 21 is magnetically a so-called air-core coil which does not have a magnetic core, such as a ferrite or iron core, since the coil 21 is supported on the non-magnetic core 20. Thus, since it is not required to use any iron cores having a complicated shape, it is possible to reduce the costs, so that it is possible to provide an inexpensive magnetic circuit. Furthermore, in the figure, reference numbers 22*a* and 22*b* denote coil temperature sensors.

A high-frequency current is supplied from an exciting circuit (not shown), such as an inverter circuit, to the exciting coil 21 to generate an eddy current in the heating roller 2 in accordance with the variation in magnetic field. By this eddy current, the heating roller 2 produces Joule heat by its electrical resistance to be heated. For example, it is possible to cause a high-frequency current having a frequency of 25 kHz and 900 W to pass through the exciting coil 21.

The induction heating device 6 in the heating roller 2 will be described in detail below. The induction heating device 6 can be embodied in various ways, and each of examples thereof will be described below.

Figure 3:
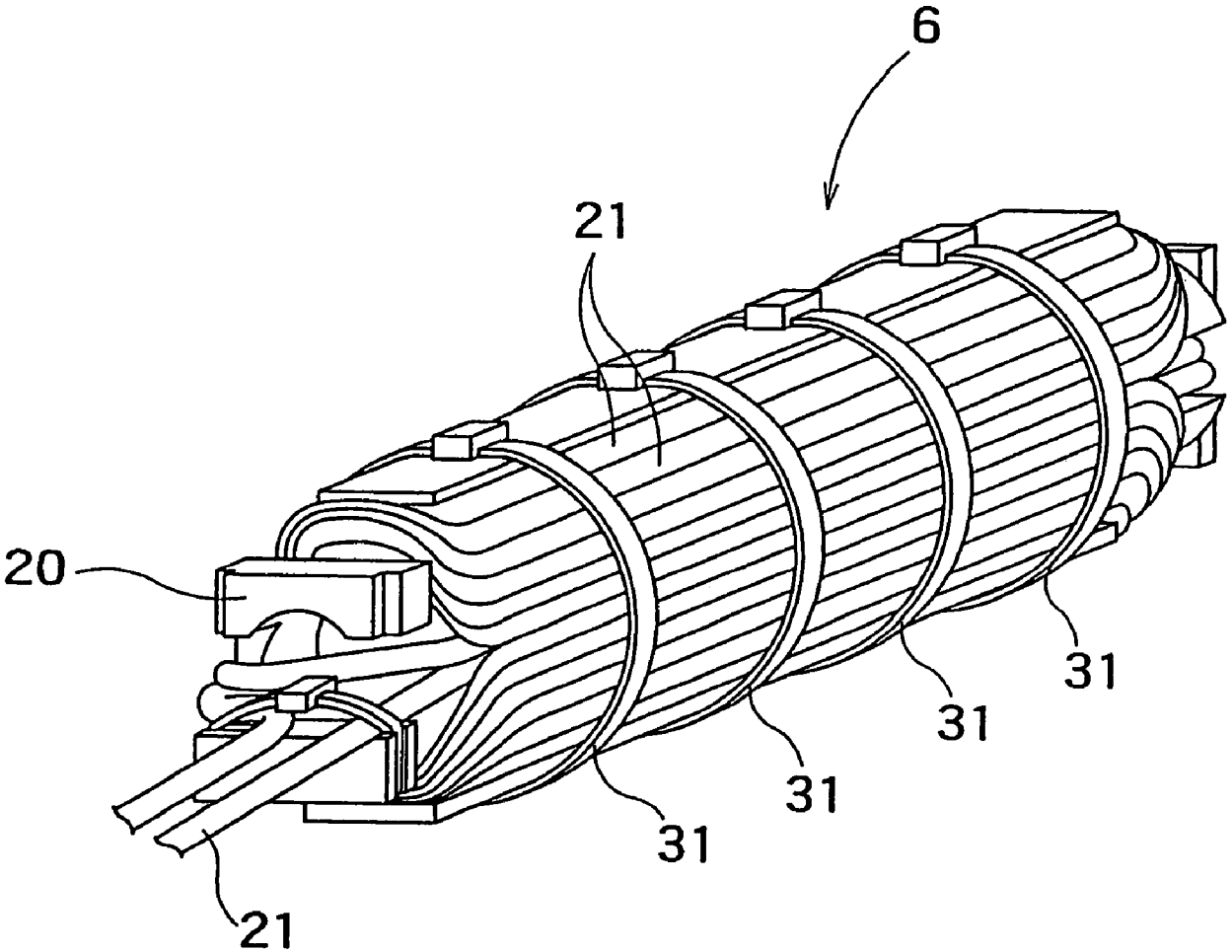
FIG. 3 is a perspective view of an example of an induction heating device.

FIG. 3 is a first example of an induction heating device 6. The induction heating device 6 in FIG. 3 uses fixing varnish mixed with mica for fixing the coils to each other and to the core in order to improve heat resistance and insulation performance. That is, in the induction heating device 6, the varnish (fixing material) used for fixing the exciting coils 21 to each other and for bonding and fixing the exciting coils 21 to the non-magnetic core 20 serving as a core thereof is blended with mica powder for improving heat resistance. The fixing material is preferably a heat resistant material which is resistant to 200° C. or higher, and may be selected from polyimide resins, epoxy resins and silicone resins. In particular, the fixing material may be a single liquid resin. The mixing ratio of the above described mica to the fixing material may be 50% or less.

The core 20 may be coated with a heat resistant resin. That is, as this holding body (core) 20, the outside surface of the supporting body (core body) of a resin serving as a raw material is coated with a paint material. This paint material may be substantially the same fixing material as the above described fixing material for fixing the coil wires to each other. By thus coating the core (holding body) 20 with the heat resistant resin, it is possible to improve the heat resistance of the core itself. Thus, it is possible to avoid the warp of the core 20 and cracks in the core 20 even if the core 20 is left as it is in high temperature atmosphere.

Moreover, the coils 21 may be fixed by heat resistant bundling bands 31, 31, . . . . That is, in order to more strongly fix the exciting coils 21 wound onto the core 20, the heat resistant bundling bands 31, 31, . . . may be wound onto the exciting coils 21 as shown in FIG. 3, if necessary. The heat resistant bundling bands may be formed of the same material as that of the core 20, which may be selected from PPSs, polyetherimides, PFAs, unsaturated polyesters, high heat resistant phenols and polyimides. Thus, by using the heat resistant bundling bands 31, it is possible to prevent the deterioration of the distances between the coils 21 and the inside surface of the heating roller 2 even if the coils are deformed by the heat cycle after operation is carried out for a long period of time.

Figure 4:
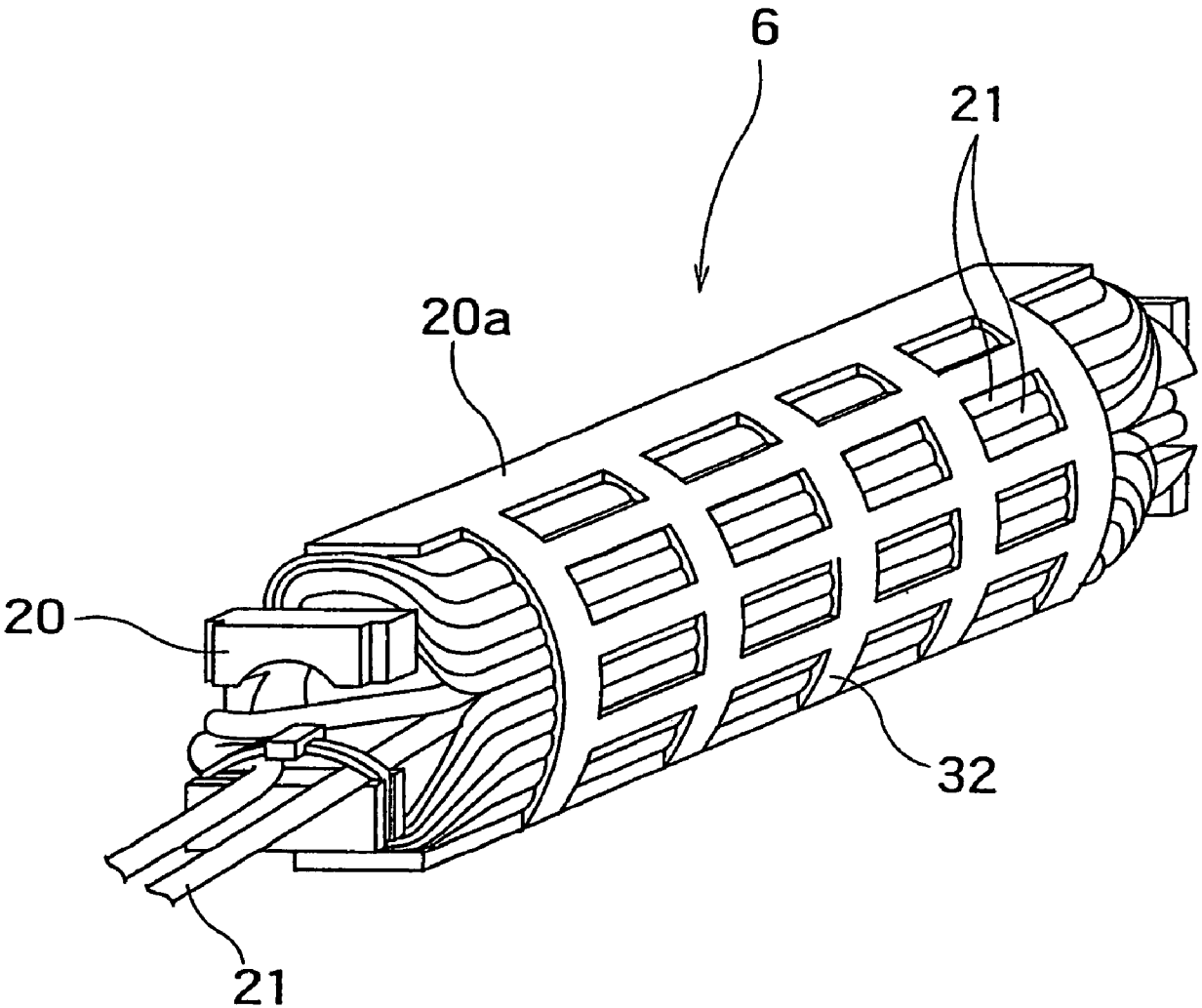
FIG. 4 is a perspective view of another example of an induction heating device.

Similarly, as can be seen from FIG. 4, the outside surfaces of the coils 21 may be coated with a molded body 32 formed of a heat resistant material after the coils 21 are wound. That is, the exciting coils 21 may be bundled by the molded body 32 which is made of the same material as that of the core 20 and which substantially has the shape of lattice. In the actual production, the whole may be formed of the same material as that of the core 20 after the exciting coils 20 are wound onto the coil core 20. Thus, as can be seen from FIG. 4, the exposed portion 20*a* of the core 20 is integral with the bundling body 32. By adopting such a construction, it is possible to obtain the same effect as that when the bundling bands 31 is used. That is, the distances between the coils 21 and the inside surface of the heating roller 2 can be constant.

Figures 5, 6:
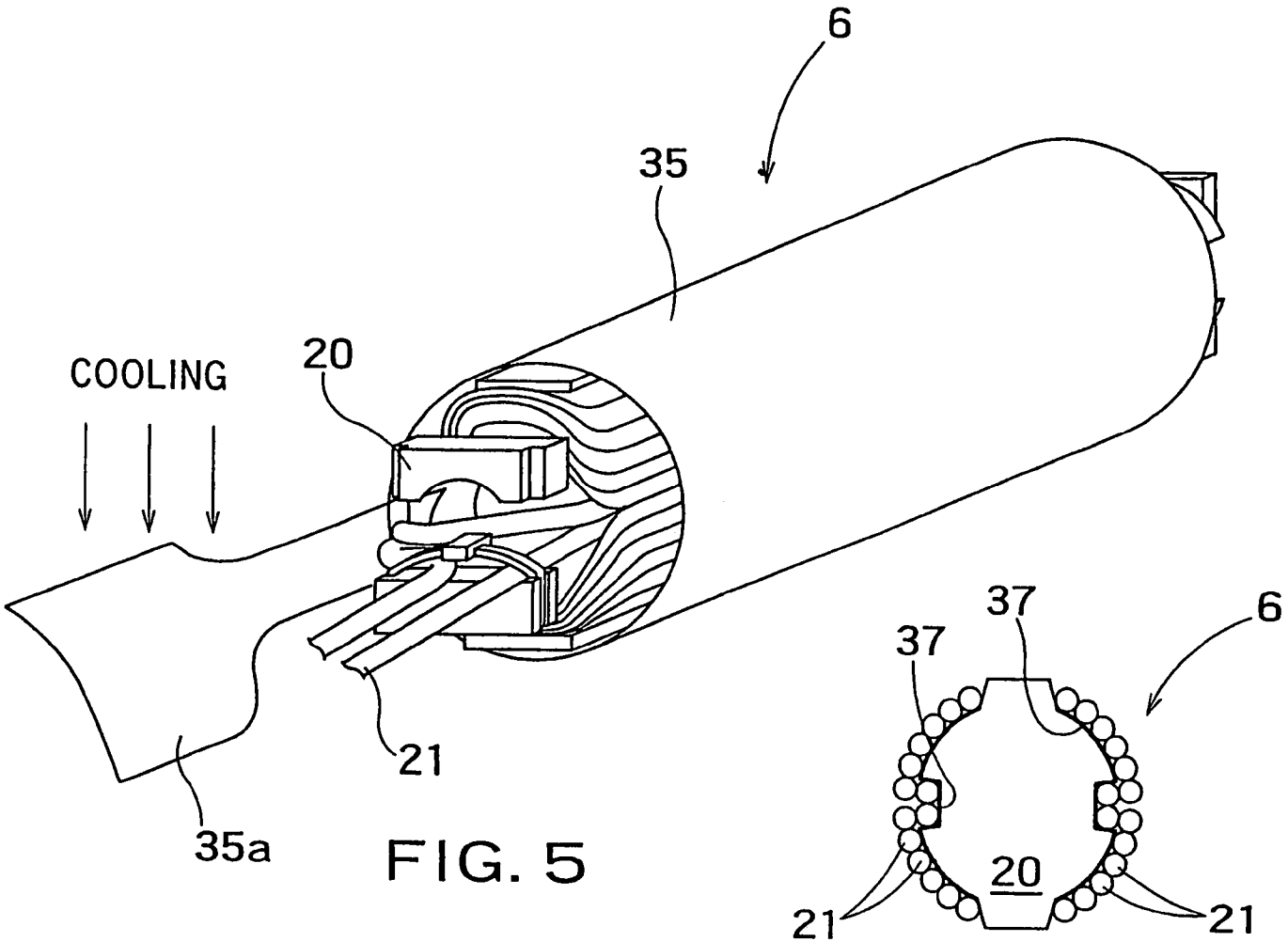
FIG. 5 is a perspective view of a further example of an induction heating device.
FIG. 6 is a cross-sectional view of a still further example of an induction heating device.

FIG. 5 is a further example different from the above described examples. That is, in FIG. 5, the outside surfaces of the exciting coils 21 are coated with a sheet 35 having heat resistance, insulation performance and thermal conductivity for providing heat radiation and insulation of the coils 21. The sheet 35 has a protruding portion 35*a* extending in an axial direction for improving cooling effect. That is, by this sheet 35, it is possible to relieve the heat generation of the coils 21 and to improve the insulation of the coils 21 from the heating roller 2. Furthermore, when the exciting coils 21 are wounded in the form of multilayer, the same sheets as the above described sheet may be provided between adjacent two of the layers.

FIG. 6 is a still further different example. In FIG. 6, the same sheets as the sheet 35 in FIG. 5, i.e., sheets 37, 37 having good heat resistance, insulation performance and thermal conductivity, are provided between the coil core 20 and the exciting coils 21 wound onto the core 20. That is, the sheets 37 serve to provide the heat generation and insulation of the coils 21, and have heat resistance, insulation and thermal conductivity. Thus, it is possible to inexpensively realize the heat radiation of the coils 21 and core 20.

FIG. 7 shows an example wherein the positions of the heating roller 2 and pressure roller 3 are slightly offset in axial directions in order to appropriately fix the toner on the fed paper in view of the heat generation distribution of the heating roller 2. That is, in the figure, C1 denotes the center of the heating roller 2 in longitudinal directions, and C2 denotes the center of the pressure roller 3 in longitudinal directions. The heating roller 2 receives a rotation driving force from a gear G engaged with the heating roller 2 on the left side in the figure. The thermal load is increased by the gear G. Moreover, the induction heating device 6 is inserted into the heating roller 2 so as to be biased to the right. Therefore, the center of the heat generating portion of the heating roller 2 is slightly offset from the geometrical center C1 to the right. That is, the position of C2 is the center of the heat generation of the heating roller 2. Therefore, the pressure roller 3 is offset to the right by d so that the center C3 of the pressure roller 3 is coincident with C2. Thus, if the paper P is fed so that the center thereof moves along the cross or axial-directional center C3 of the pressure roller 3, the toner on the paper P can be appropriately fixed so as to be laterally symmetric. That is, even if the heat capacity of the heating roller 2 is uneven in axial directions due to the driven means, such the gear, of the heating roller 2, the heat generation distribution of the heating roller 2 can be optimized in accordance with the relationship between the heating roller 2 and the paper P.

Figure 8:
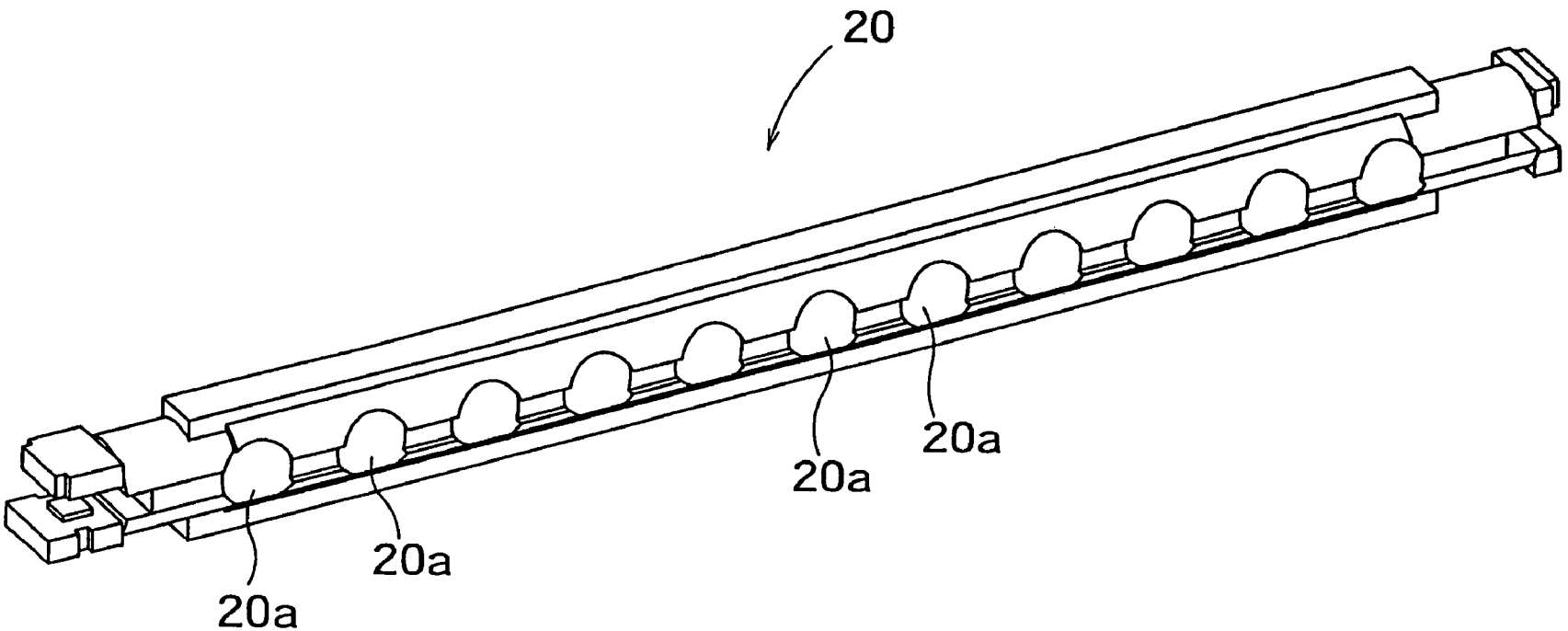
FIG. 8 is a perspective view of a core of an electromagnetic induction coil.

FIG. 8 shows an example of a coil core 20. The coil core 20 has a plurality of through holes 20*a*, 20*a*, . . . extending in a lateral direction substantially perpendicular to the axis thereof. By thus forming the through holes 20*a*, it is possible to prevent the radiation heat from the heating roller 2 and the heat reserve of Joule heat from the coils 21 themselves, and it is possible to promote heat radiation. Moreover, it is possible to lighten the holding body 20 itself, and it is possible to reduce the material costs.

Figure 9:
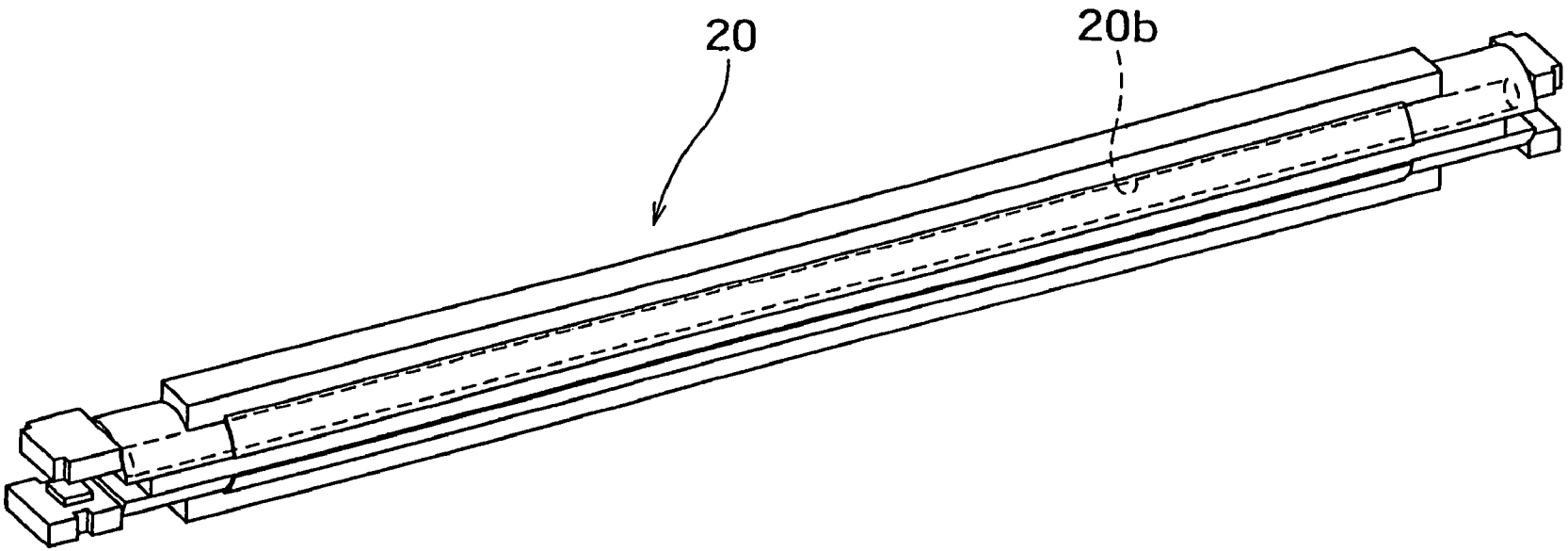
FIG. 9 is a perspective view of another example of a core of an electromagnetic induction coil.

FIG. 9 shows an example wherein the core 20 has a hole 20*b* extending in axial directions for the same object as that of the above described example. The hole 20*b* can have the same effects as those of the holes 20*a*. The core 20 may have a hole 20*b* which does not passes therethrough. The hole 20*b* serves to relieve heat in longitudinal directions.

Figure 10:
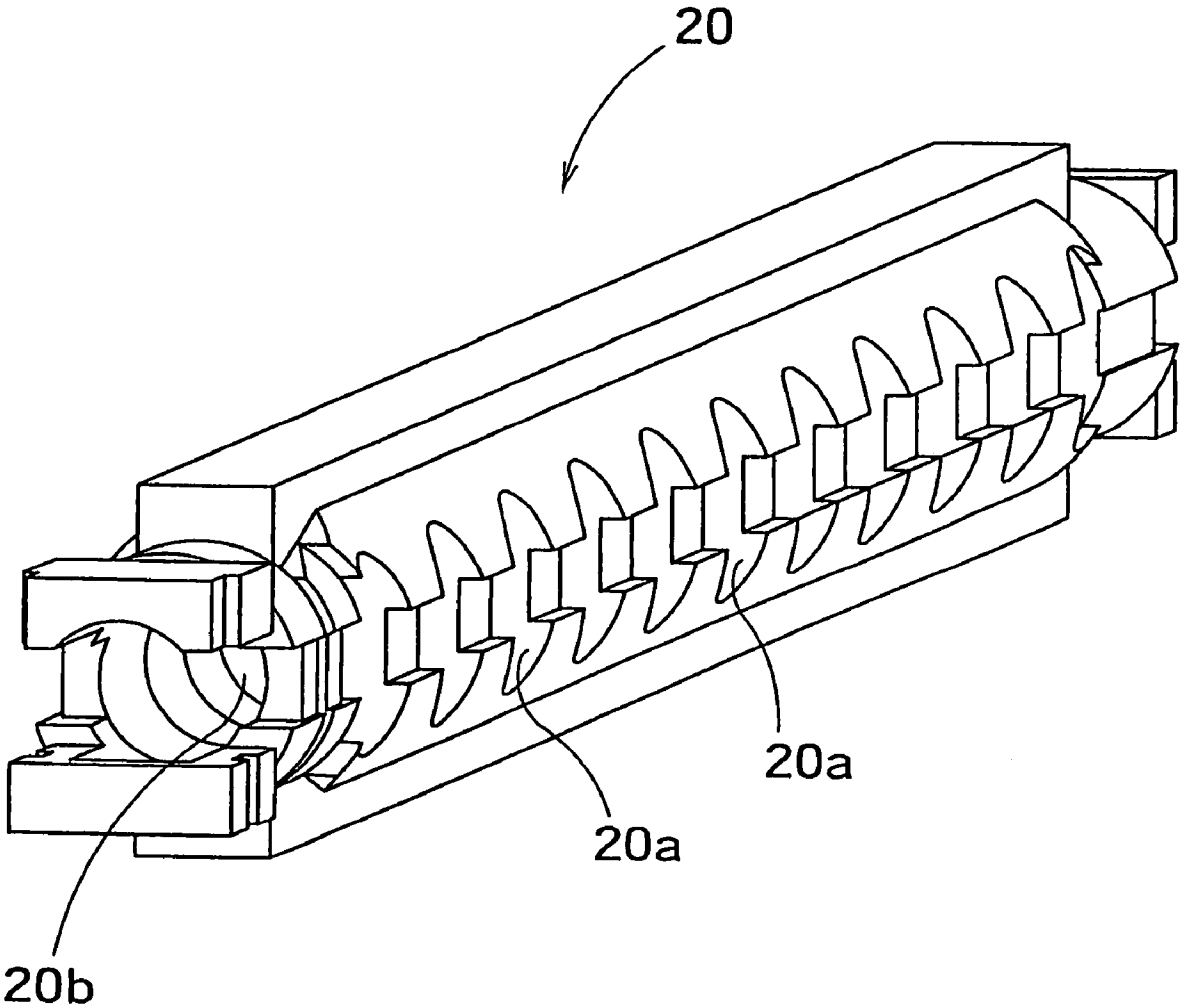
FIG. 10 is a perspective view of a further example of a core of an electromagnetic induction coil.

Of course, two kinds of holes 20*a* and 20*b* shown in FIGS. 8 and 9 may be simultaneously provided as shown in FIG. 10. In this case, the two kinds of holes 20*a* and 20*b* are communicated with each other in the axial center portion.

In these example, blowing means may be provided for the hole 20*b* extending in axial directions so as to more efficiently blow and cool.

Figure 11:
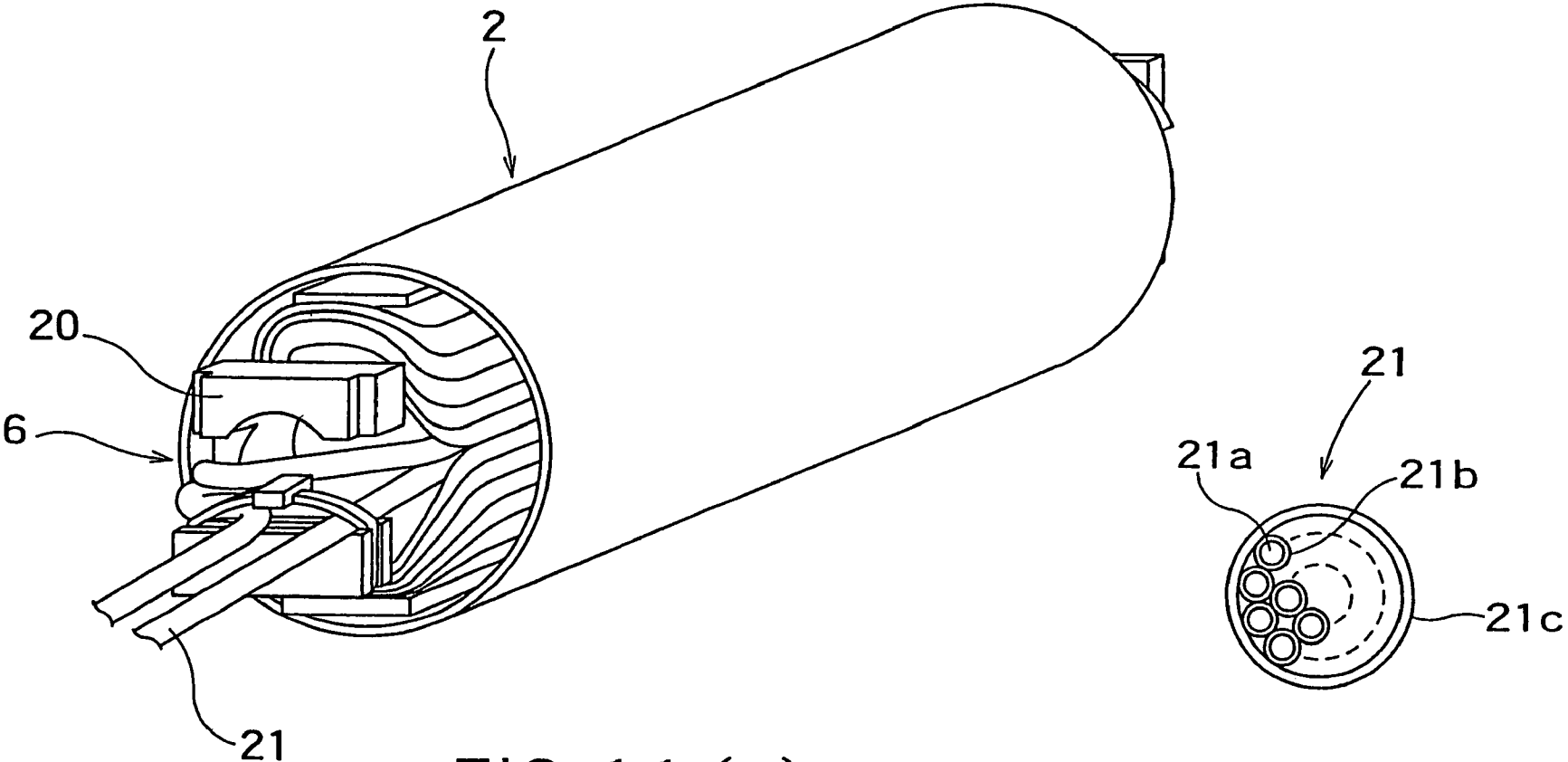
FIG. 11(*a*) is a perspective view of another example of an induction heating device and a heating roller, and FIG. 11(*b*) is a sectional view of a litz wire.

FIGS. 11(*a*) and 11(*b*) show an example wherein double or more insulation is provided between the exciting coils 21 and the heating roller 2. Specifically, as can be seen from FIG. 11(*b*), the exciting coils 21 uses the litz lines as described above. That is, a plurality of unit wires, each of which comprises a thin conductors 21*a* insulated by a coating 21*b* of a polyimide or enamel, are bundled to be substituted for a single thick wire. Outside of the bundled wires, a thick insulating tube 21*c* for coating the wires is provided. Thus, each of the thin conductors 21*a* is doubly isolated from the body 2*a* of the heating roller 2. By such double or more insulation, it is possible to more surely prevent leakage due to dielectric breakdown even if the coils 21 are close to the body 2*a* of the heating roller 2.

According to the above described preferred embodiments of the present invention, the following effects can be obtained as described above.

(1) By mixing the fixing varnish of the core for fixing the coils to the core with mica, it is possible to improve heat resistance and insulation performance.

(2) By applying the heat resistant resin on the coil core, it is possible to improve the heat resistance of the core itself, so that it is possible to avoid warp and cracks even if the core is left as it is in high temperature atmosphere.

(3) By fixing the coils by the heat resistant bundling bands, it is possible to prevent the variation in distance from the object to be heated even if the coils are deformed by the heat cycle after operation is carried out for a long period of time.

(4) By coating the outside surfaces of the coils with the heat resistant material after forming the coils, it is possible to prevent the variation in distance from the object to be heated even if the coils are deformed by the heat cycle after operation is carried out for a long period of time.

(5) By providing the heat resistant, insulating and heat conductive sheet serving to provide the heat radiation and insulation of the coils between the surfaces of the coils and the outside of the object to be heated, it is possible to relieve the heat generation of the coils, and it is possible to surely the insulation performance of the object to be heated from the coils even if the object to be heated is made of a metal.

(6) By providing the heat resistant, insulating and heat conductive sheet serving to provide the heat radiation and insulation of the coils between the coils and the core, it is possible to radiate the heat of the coils and core, and it is possible to form the system of an inexpensive material.

(7) By arranging the coils and the object to be heated so that the centers thereof are not coincident with each other in a direction perpendicular to the feeding direction of the fixed material, it is possible to optimize the heat generation distribution even if the heat capacity is uneven in directions perpendicular to the fixing direction of the fixed material due to the driving means of the object to be heated.

(8) By forming the holes in the core, it is possible to lighten the core, and it is possible to reduce the material to be used. Moreover, it is possible to avoid the radiation heat from the object to be heated and the heat reserve of Joule heat generated from the wires themselves., and it is possible to form the system of an inexpensive material.

(9) By forming the holes in the core, it is possible to lighten the core, and it is possible to reduce the material to be used. Moreover, it is possible to avoid the radiation heat from the object to be heated and the heat reserve of Joule heat generated from the wires themselves, and it is possible to form the system of an inexpensive material. Moreover, it is possible to relieve heat in longitudinal directions.

(10) By providing double insulation, it is possible to prevent leakage due to dielectric breakdown even if the object to be heated is close to the coils.

According to the present invention, it is possible to provide a light and inexpensive fixing device for an electrophotography system, i.e., a light and inexpensive fixing device having at least an induction heating device and a heating roller heated by the induction heating device, the fixing device having excellent heat resistance, heat radiating performance and insulation performance, the heating roller being uniformly heated, and the fixing device being capable of appropriately fixing a fixed material (paper), which is fed, even if the thermal load distribution of the heating roller is not geometrically balanced.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A fixing device using induction heating for causing alternating current to pass through an electromagnetic induction coil, which is arranged so as to be close to an endless member having a metal layer of a conductive material, to cause said endless member to generate heat to heat a member to be fixed, wherein said electromagnetic induction coil comprises a litz wire that includes a plurality of twisted single wires, each of said single wires being a conductor coated by a first insulating coating, and wherein said litz wire which comprises the plurality of single wires is coated by a second insulating coating, wherein a bonding of turns of said electromagnetic induction coil to each other and a bonding of said electromagnetic induction coil to a core to be wound, are carried out by an adhesive material mixed with mica, and wherein a central portion in an axial direction of a thermal load of said endless member, which is heated by said electromagnetic induction coil, is different from a central portion in an axial direction of said endless member.

2. A fixing device comprising:

an endless member in a cylindrical shape having a metal layer of a conductive material; and a coil unit located close to the endless member, the coil unit including:

a core formed of a heat-resistant resin;

a first heat-resistant resin layer of a heat-resistant resin, which is different from the heat resistant resin forming the core, the first heat-resistant resin layer being formed on an outer surface of the core;

a coil wound around the core, on which the first heat-resistant resin layer is formed, the coil being formed of a litz wire that includes a plurality of single wires; and a second heat-resistant resin layer for adhesively bonding windings of the coil together, wherein the second heat-resistant resin layer further bonds and fixes the coil and the core together.

3. The fixing device according to claim 2, wherein the endless member is a roller having a driving gear at one end and having bearings at both ends.

4. The fixing device according to claim 2, wherein the first and second heat-resistant resin layers are formed of a material selected from the group consisting of a polyimide resin, an epoxy resin, and a silicone resin, and are resistant to a temperature of 200° C of higher.

5. The fixing device according to claim 2, wherein the first and second heat-resistant resin layers contain 50% or less by weight of mica.

6. The fixing device according to claim 2, wherein the single wires coated with polyamidelmide or polyamide.

7. The fixing device according to claim 6, wherein the litz wire is covered by an insulating tube of polyamidelmide or polyamide.

8. A fixing device comprising:

an endless member in a cylindrical shape having a metal layer of a conductive material; and a coil unit located close to the endless member, the coil unit including:

a core formed of a heat-resistant resin;

a first heat-resistant resin layer of a layer of a heat-resistant resin, which is different from the heat resistant resin forming the core, the first heat-resistant resin layer being formed on an outer surface of the core;

a coil wound around the core, on which the first heat-resistant resin layer is formed, the coil being formed of a litz wire that includes a plurality of single wires; and a second heat-resistant resin layer coated on a surface of the coil unit, wherein the second heat-resistant resin layer bonds and fixes the single wires together, and bonds and fixes the coil and the core together, wherein the endless member is a roller having a driving gear at one end and having bearings at both ends, and wherein the coil unit is arranged along a longitudinal direction of the roller, and a central portion of the roller in the longitudinal direction does not match a central portion of the coil in a longitudinal direction.

9. The fixing device according to claim 8, wherein the core has a plurality of holes opened in a direction perpendicular to the longitudinal direction of the roller.

* * * * *